US006176474B1

(12) United States Patent
Stanek et al.

(10) Patent No.: US 6,176,474 B1
(45) Date of Patent: Jan. 23, 2001

(54) HUMIDIFIER BOTTLE WITH SIDE FILL/SIDE DISPENSING CAP

(75) Inventors: Terrence L. Stanek, St. Charles; Mark J. Tomasiak, O'Fallon; Steven L. Rhea, St. Peters, all of MO (US)

(73) Assignee: Emerson Electric Co., St. Louis, MO (US)

( * ) Notice: Under 35 U.S.C. 154(b), the term of this patent shall be extended for 0 days.

(21) Appl. No.: 09/201,996

(22) Filed: Dec. 1, 1998

(51) Int. Cl.[7] ..... B65D 35/46
(52) U.S. Cl. ..... 261/66; 261/72.1
(58) Field of Search ..... 261/66, 72.1, 104, 261/107; 222/192, 562; 220/86.1

(56) References Cited

U.S. PATENT DOCUMENTS 4,663,091 * 5/1987 Seo ..... 261/72.1
5,480,588 1/1996 Tomasiak et al. ..... 261/72.1
5,482,190 * 1/1996 Stanek et al. ..... 261/72.1
5,682,932 * 11/1997 Ediger ..... 261/72.1
5,746,359 * 5/1998 Stanek et al. ..... 261/72.1
5,967,380 * 10/1999 Litvin ..... 261/72.1

FOREIGN PATENT DOCUMENTS

595590 * 2/1978 (CH) ..... 261/107

* cited by examiner

*Primary Examiner*—David A. Simmons
*Assistant Examiner*—Robert A. Hopkins
(74) *Attorney, Agent, or Firm*—Howrey Simon Arnold & White, LLP

(57) ABSTRACT

Herein is disclosed a water bottle for use in a humidifier, comprising a bottom wall, an upwardly extending sidewall, a top wall, a water filling and dispensing opening formed in the sidewall, and a water filling and dispensing cap mounted over the water filling and dispensing opening. Also disclosed is a humidifier, comprising at least one water bottle of the present invention.

11 Claims, 6 Drawing Sheets

HUMIDIFIER BOTTLE WITH SIDE FILL/SIDE DISPENSING CAP

BACKGROUND OF THE INVENTION

1. Field of the Invention

The present invention is related to the field of humidifiers and water bottles for use therein. Specifically, the present invention is related to humidifier water bottles with a water filling and dispensing cap mounted on the side of the water bottle.

2. Description of Related Art

Humidifiers are principally used during winter to add moisture to room air. As is well known, the capacity of air to carry water vapor is reduced as temperature decreases, and the use of electric or gas heating also tends to lower the moisture of room air. Humidification of room air leads to improved protection of the human respiratory system against viruses and air pollutants, amelioration of some symptoms of the common cold, and amelioration of atopic dermatitis. Humidification of room air also can reduce static electricity and protect furniture and upholstery.

A wide variety of humidifiers have been constructed. Variation has been seen in the humidification mechanism (e.g. centrifugal pump/evaporative filter, air-blown wicking/evaporative element, motor driven belt pad, wicking element humidifiers, etc.) and in the intended place of mounting, i.e. tabletop or floor-mounted. Many humidifiers have made use of water bottles in which the water-dispensing opening is located in the bottom wall of the bottle, and the water-fill opening is located in either the bottom or the top wall of the bottle.

Filling such water bottles, however, is often difficult. Typically, and especially for larger humidifiers, the water bottles are tall and do not fit conveniently, or at all, beneath faucets for filling. This disadvantage was addressed by Tomasiak et al. in U.S. Pat. No. 5,450,588, who disclosed a water bottle with a water-dispensing opening located in the bottom wall of the bottle, and a water-fill opening located in the sidewall of the bottle.

The two separate openings required by the water bottle disclosed by Tomasiak et al. may result in increased manufacturing cost and complexity. The present invention addresses these and other shortcomings associated with the prior art.

SUMMARY OF THE INVENTION

The present invention relates to a water bottle for use in a humidifier, comprising a bottom wall, an upwardly extending sidewall, a top wall, a water filling and dispensing opening formed in the sidewall, and a water filling and dispensing cap mounted over the water filling and dispensing opening.

The present invention also relates to a humidifier, comprising: a water reservoir base, a humidification unit mounted on the base, and at least one water bottle mounted on the base, the water bottle comprising a bottom wall, an upwardly extending sidewall, a top wall, a water filling and dispensing opening formed in the sidewall, and a water filling and dispensing cap mounted over the water filling and dispensing opening.

DETAILED DESCRIPTION OF THE INVENTION

Figure 1:
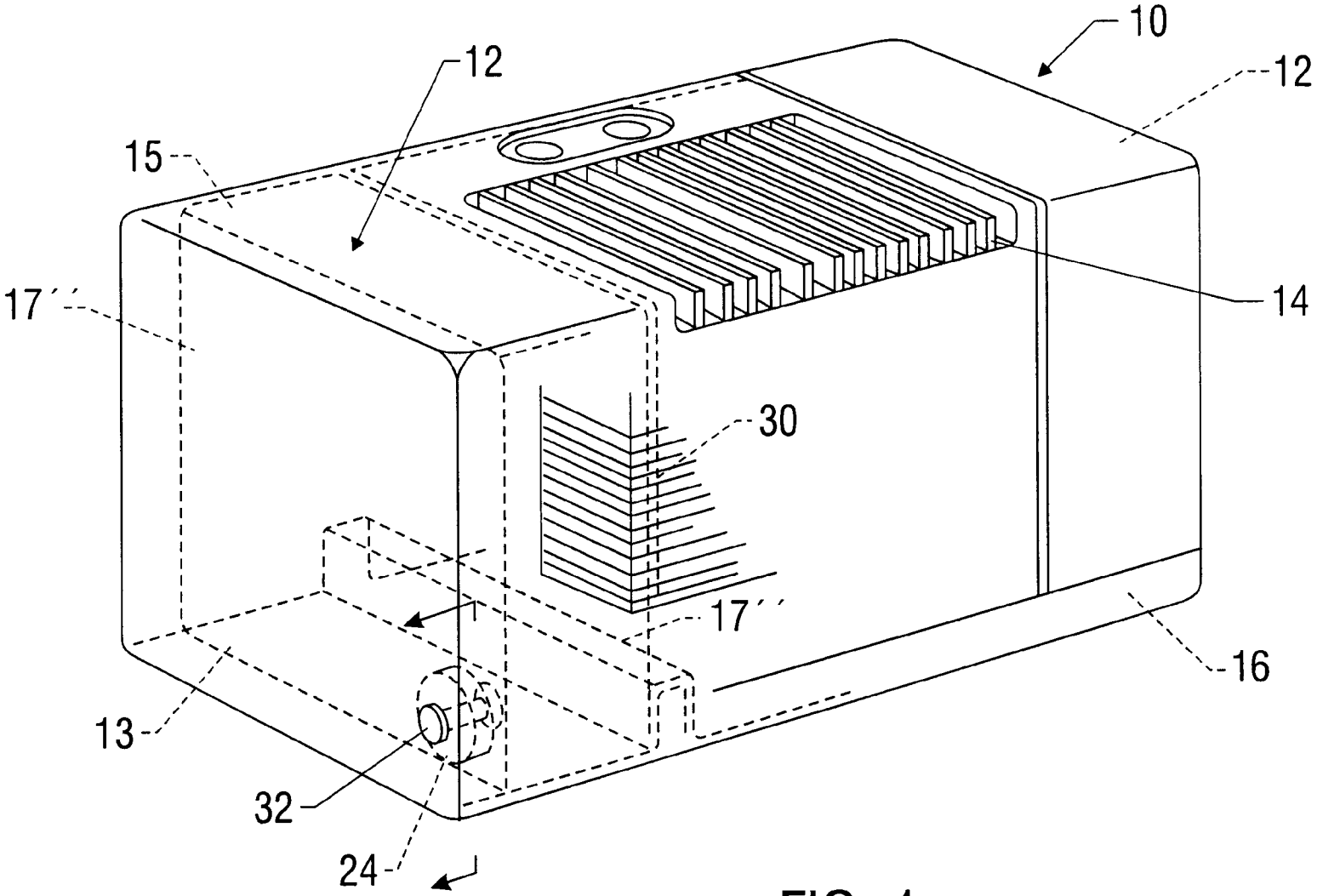
FIG. 1 is a perspective view of a humidifier comprising a water bottle according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 shows an exemplary humidifier in accordance with the present invention. The exemplary humidifier is not to be construed as a limitation on the spirit and scope of the present invention. Briefly, a humidifier 10 comprises a water reservoir base 16, a humidification unit 14, and at least one water bottle 12. The exemplary humidifier has two water bottles 12 positioned on opposite ends of and adjacent to the humidification unit 14. The water reservoir base 16 is provided with an upstanding rectangular-shaped circumferential wall in order to receive the humidification unit and at least one water bottle. Additional projections or recesses in the bottom wall or circumferential wall of the water reservoir base 16 can be provided to facilitate mounting of the humidification unit 14 or the at least one water bottle 12, as described below.

In the exemplary humidifier, the humidification unit 14 comprises a motor driven fan (not shown) and a wicking filter (not shown). The wicking filter is designed to rest at a height above the bottom wall of the water reservoir base 16 sufficient to allow absorption and capillary action to wick water along the entire height of the wicking filter. The mode of operation of the humidifier is known to the skilled artisan. Briefly, the motor driven fan draws outside air through a grill at the rear of the unit (not shown) and passes the outside air through the wicking filter to allow absorption of moisture into the air and subsequent release of the humidified air through a grill at the top of the unit (not shown). It will become clear to one skilled in the art that humidifiers with alternative modes of action may be constructed using a water bottle of the present invention, and are thus within the spirit and scope of the present invention.

The present invention relates to the water bottle 12 and its manner of association with the humidifier 10.

At least one water bottle 12 is mounted on the water reservoir base 16 of the humidifier 10. The water bottle 12 is adjacent to at least one side wall of the water reservoir base 16. The side wall of the water reservoir base 16 can be of any height sufficient to ensure both secure seating of the water bottle 12 in the water reservoir base 16 and containment of water in the water reservoir base 16 without water rising above the top of the side walls. Further features of the side walls of the water reservoir base 16 will be described below. Preferably, the side walls of the water reservoir base 16 are no higher than necessary to accomplish the above-noted requirements, in order to eliminate excess material in the outside walls of the humidifier.

Figure 2:
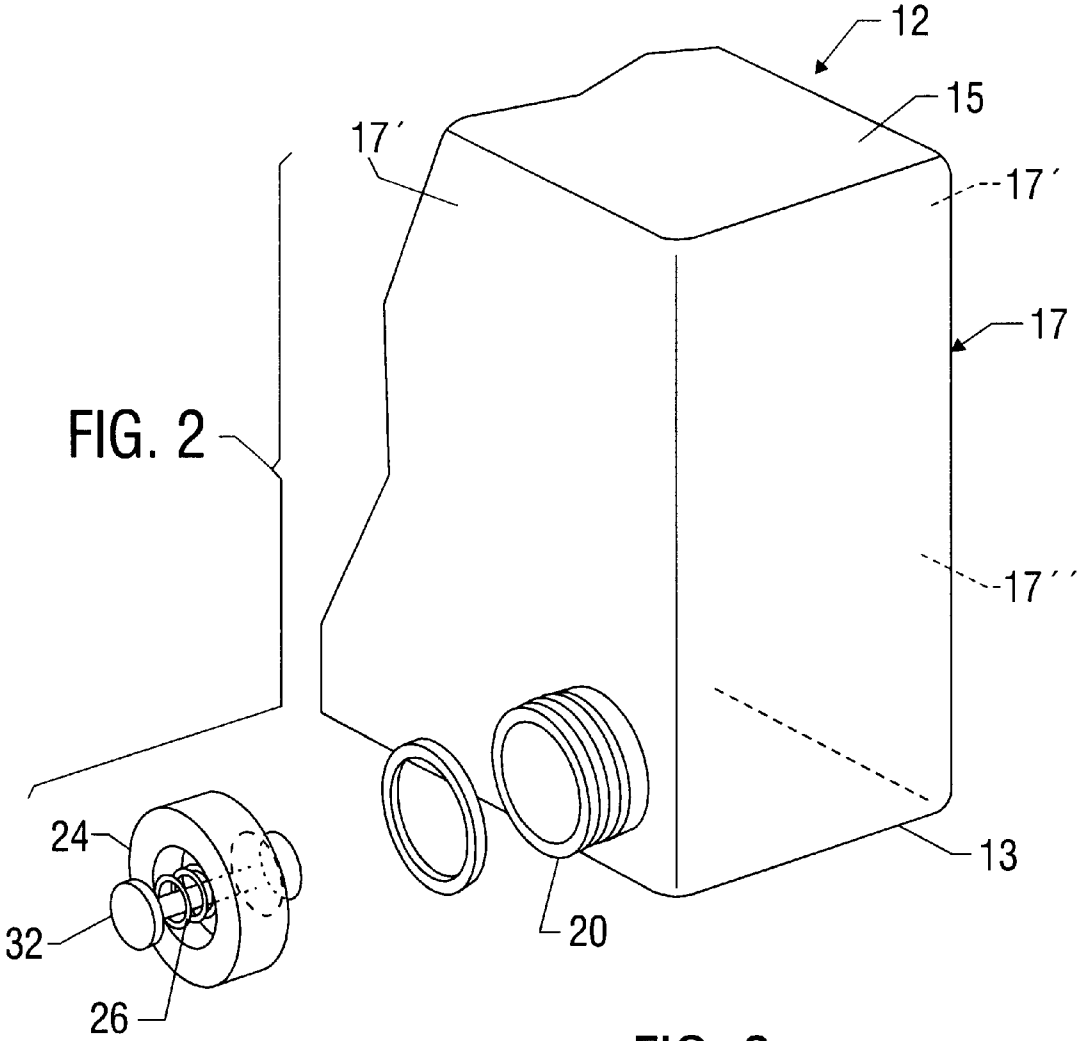
FIG. 2 is a fragmentary perspective view of a water bottle and a water filling and dispensing cap according to the present invention.

FIG. 2 shows a water bottle 12 in accordance with the present invention has a bottom wall 13, a top wall 15, and interconnecting sidewall 17 which extends between the top wall 15 and the bottom wall 13. In an exemplary embodiment, the sidewall 17 comprises opposed pairs of side walls 17' and 17". The first opposed pair of side walls 17" are spaced substantially further apart than the second opposed pair of side walls 17', imparting to the water bottle 12 a height and depth much greater than its width.

A handle (not shown) can be provided at the upper end of the water bottle 12. In one embodiment, the handle is integrally molded and formed in the water bottle 12 with an elongated opening (not shown) therebelow for grasping of the handle by the user. In addition, the inside faces of the second opposed pair of side walls 17' preferably include a series of reinforcing ribs (not shown) for strengthening the water bottle 12. Such handles and reinforcing ribs are well-known in the art.

The water bottle 12 also has means for filling and dispensing water and means for regulating the filling and dispensing of water. The means for filling and dispensing water can be an opening of any size and shape, and the means for regulating the filling and dispensing of water can be a cap secured on the opening by threadable mounting, pressure mounting, or other techniques known in the art.

In the embodiment shown in FIGS. 1–4, extending outwardly from the sidewall 17 of the water bottle 12 is a threaded water filling and dispensing spout 20. Preferably, the water filling and dispensing spout extends outwardly from one of the side walls 17'. Threadably mounted thereon is a water filling and dispensing cap 24. The water filling and dispensing spout 20 defines a water filling and dispensing opening. Preferably, the water filling and dispensing spout 20 is located in proximity to the bottom wall 13 of the water bottle 12. In order to fill the water bottle 12, the water bottle 12 can be rotated to a position wherein the water filling and dispensing spout 20 is beneath a water faucet. The water filling and dispensing cap 24 is then threadably dismounted and water added. Thereafter the water filling and dispensing cap 24 is threadably mounted on the water filling and dispensing spout 20. The water filling and dispensing cap 24 and/or the water filling and dispensing spout 20 can be provided with means for sealing to prevent leaking or dripping of water through the threads of the water filling and dispensing spout 20. The means for sealing can be Teflon tape, a washer, or any other similar object known to those of skill in the art.

Figure 4:
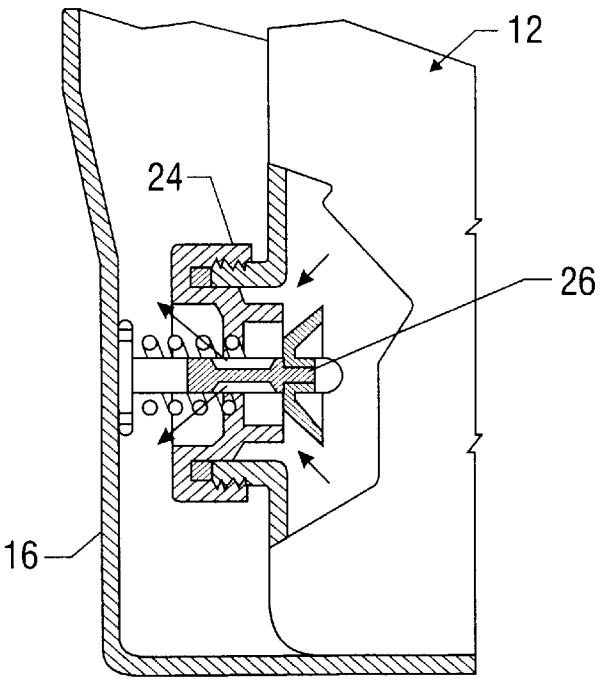
FIG. 4 is a cutaway front elevation view of a water bottle according to the present invention mounted in a humidifier.
Figure 3:
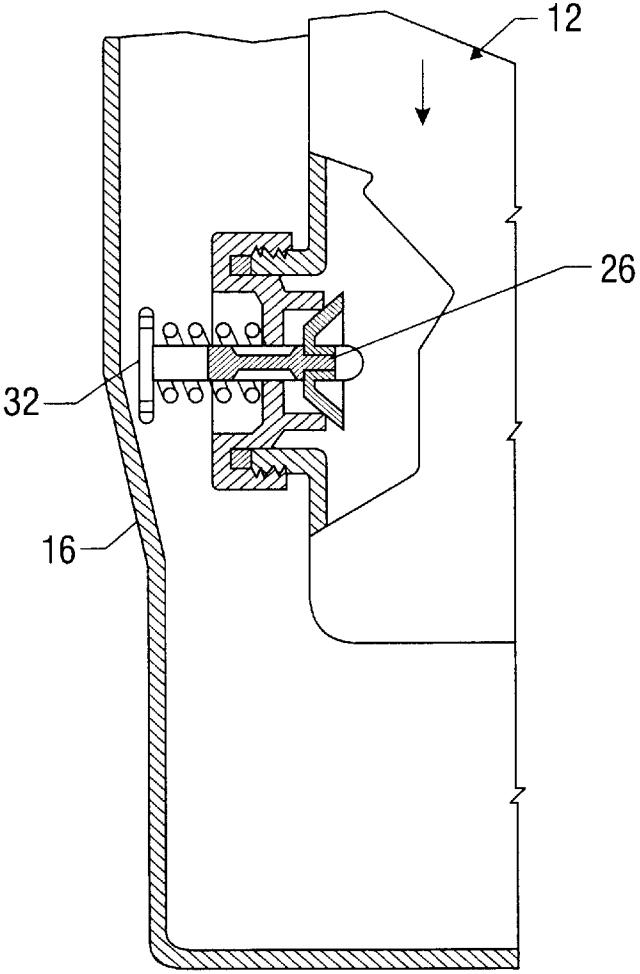
FIG. 3 is a cutaway front elevation view of a water bottle according to the present invention in the act of mounting in a humidifier.

An additional feature of the water filling and dispensing cap 24 is its provision of means for allowing the dispensing of water. An example of such means, shown in FIGS. 3 and 4, is a spring biased valve stem 26, as is known in the art. A suitable spring biased valve stem is disclosed in U.S. Pat. No. 5,061,405. FIGS. 3 and 4 illustrate the configuration of the water bottle 12 within the water reservoir base 16 in accordance with one embodiment of the present invention. The spring biased valve stem 26 is normally operative to prevent water from being discharged through the water filling and dispensing cap 24. However, when the spring biased valve stem 26 is engaged by means for activating the dispensing of water, such as a fixed button valve actuator 32, water from the water bottle 12 is discharged around the valve 26 until the water level 34 in the water reservoir base 16 reaches a preselected level, at which point the flow of water will be halted until air is again allowed to enter the water bottle 12.

Unlike other known designs, wherein the spring biased valve stem 26 for water dispensing is located on a cap mounted on a spout depending from the bottom wall of a water bottle, in the present invention the spring biased valve stem 26 for water dispensing is located on the water filling and dispensing cap 24 mounted on a water filling and dispensing spout 20 extending from the sidewall 17' of the water bottle 12.

To facilitate engagement of the spring biased valve stem 26, the side wall of the water reservoir base 16 can be sloped, or the side wall can be straight and feature a wedge shaped plate.

As mentioned above, the bottom wall of the water reservoir base 16 can have projections or depressions to facilitate mounting of the water bottle 12. In some embodiments, the water bottle 12 can have projections or depressions complementary to those of the water reservoir base 16 in order to further facilitate mounting of the water bottle 12.

Figure 5:
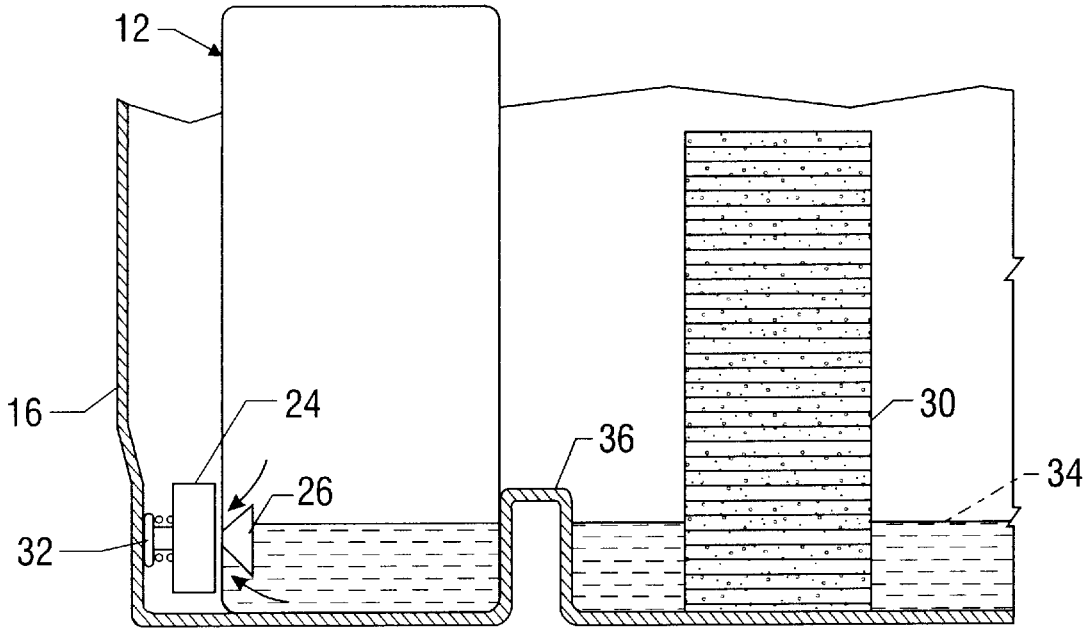
FIG. 5 is a front elevation view of a water bottle and a humidifier according to one embodiment of the present invention.
Figure 6:
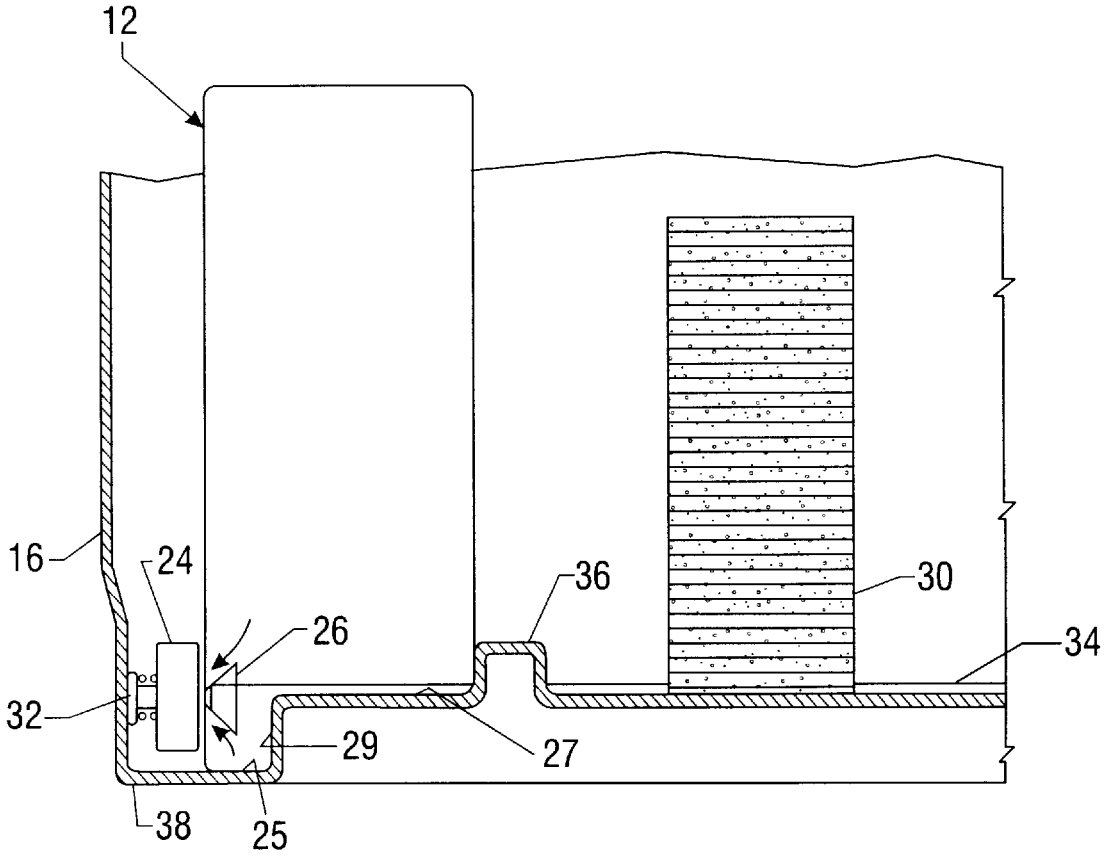
FIG. 6 is a front elevation view of a water bottle and a humidifier according to another embodiment of the present invention.

In the embodiment shown in FIGS. 5 and 6, a projection 36 extends upwardly from the bottom wall of the water reservoir base 16. The projection 36 is formed parallel to a side wall 17' of the water bottle 12, and the side of the projection 36 nearest the side wall of the water reservoir base 16 is spaced at a distance from the side wall of the water reservoir base 16 sufficiently equal to the combined width of the water bottle 12 with water filling and dispensing spout 20 and water filling and dispensing cap 24 mounted thereon and the fixed button valve actuator 32, such that the projection 36 is adjacent the side wall 17' of the water bottle 12, in order to effect a snug fit of the water bottle 12 in engagement with the fixed button valve actuator 32. The projection 36 may be of any height so long as the height is sufficient to ensure the water bottle 12 is fit snugly in engagement with the fixed button valve actuator 32. If the height of the projection 36 is greater than the anticipated water level 34 in the water reservoir base 16, the projection 36 must be formed with openings therethrough to allow passage of water through the projection 36 and to the wicking filter 30.

In the embodiment shown in FIG. 5, the water bottle 12 will not be completely emptied. The level of water in the water reservoir base 16 will rise to the water level 34. In addition, the humidification unit 14 can only evaporate water from the portion of the wicking filter 30 higher than the water level 34, whereas the portion of the wicking filter 30 below the water level 34 will not be useful in humidification.

In the embodiment shown in FIG. 6, the bottom wall 13 of the water bottle 12 is step-shaped when observed in frontal elevation. The bottom wall 13 features a lower horizontal section 25 and an upper horizontal section 27, joined by a vertical section 29. The water filling and dispensing spout 20 is formed on the side wall 17 of the water bottle 12 at close proximity to the lower horizontal section 25 of the bottom wall 13.

A depression 38 is formed in the water reservoir base 16 in order to lower the water level 34. Specifically, the vertical section 29 of the depression 38 opposite the side wall of the water reservoir base 16 is spaced at a distance from the side wall of the water reservoir base 16 sufficiently equal to the combined width of the water bottle 12 with water filling and dispensing spout 20 and water filling and dispensing cap 24 mounted thereon and the fixed button valve actuator 32, in order to effect a snug fit of the water bottle 12 in engagement with the fixed button valve actuator 32. A projection 36 can also be formed in the water reservoir base 16 as described above to aid seating of the water bottle 12; however, projection 36 is an optional feature of the embodiment shown in FIG. 6.

In the embodiment of FIG. 6, a lesser volume of water can be discharged from the water bottle 12 than can be discharged in the embodiment illustrated in FIG. 5 described above. An advantage of the embodiment of FIG. 6 is that the water level 34 is far lower on the wicking filter 30, thereby enhancing the effective evaporative volume of the wicking filter 30 and increasing the efficiency of the humidification unit 34.

Figure 7:
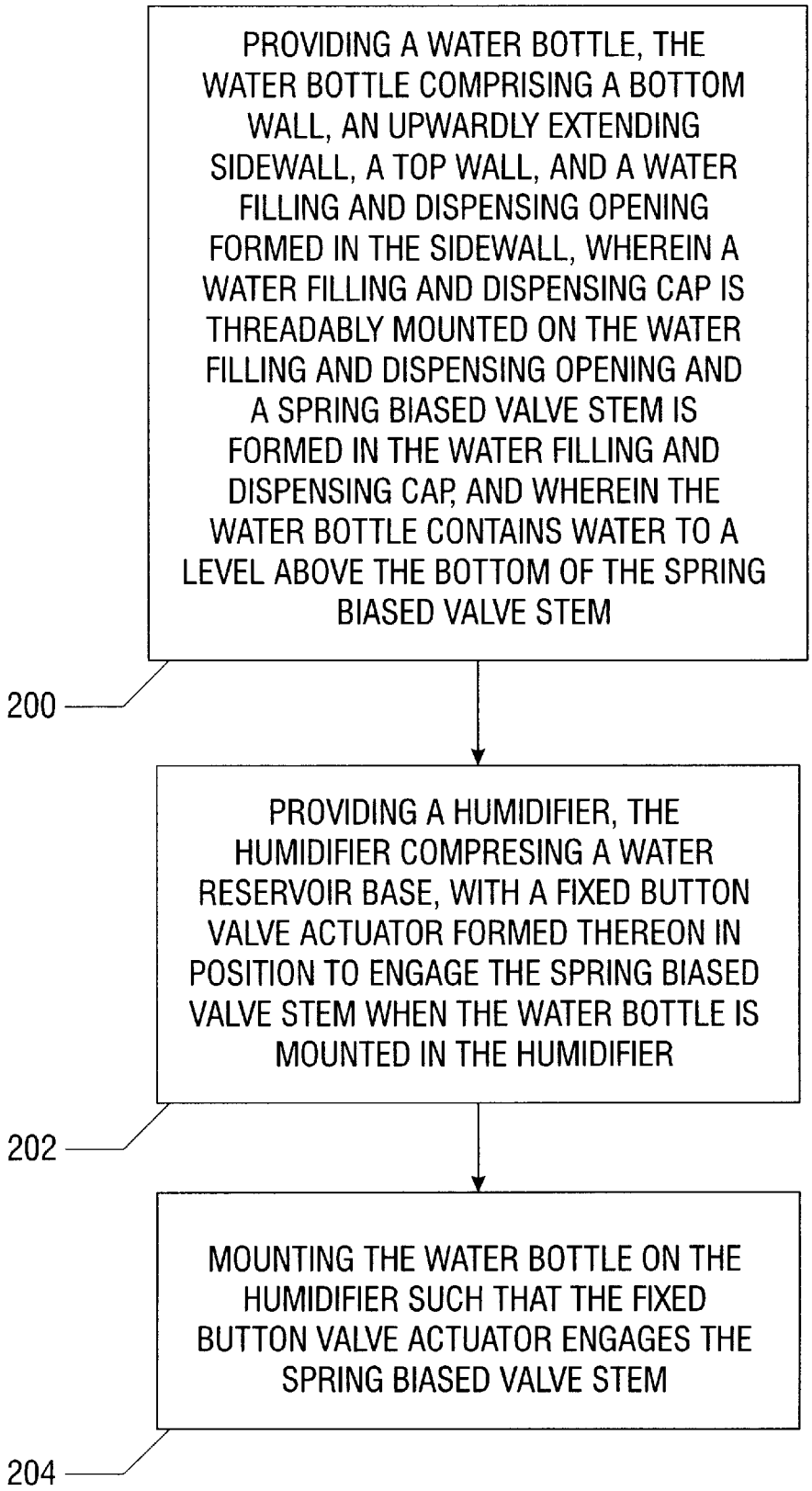
FIG. 7 is a flowchart showing the steps in a method of dispensing water from a water bottle according to the present invention.

FIG. 7 is a flowchart showing the steps in a method of dispensing water from a water bottle according to the present invention. The method comprises providing the water bottle, the water bottle comprising a bottom wall, an upwardly extending sidewall, a top wall, and a water filling and dispensing opening formed in the sidewall, wherein a water filling and dispensing cap is threadably mounted on the water filling and dispensing opening and a spring biased valve stem is formed in the water filling and dispensing cap, and wherein the water bottle contains water to a level above the bottom of the spring biased valve stem; providing the humidifier, the humidifier comprising a water reservoir base with a fixed button valve actuator formed thereon in position to engage the spring biased valve stem when the water bottle is mounted in the humidifier; and mounting the water bottle on the humidifier such that the fixed button valve actuator engages the spring biased valve stem.

Figure 8:
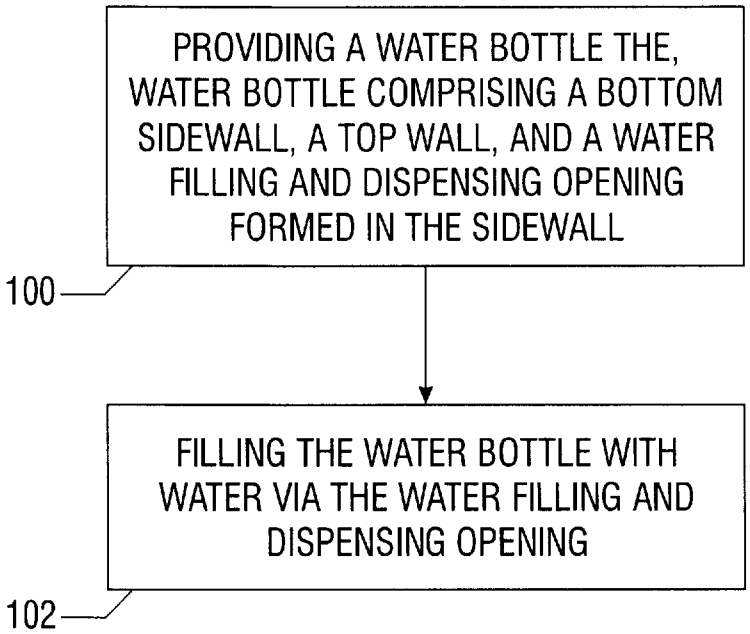
FIG. 8 is a flowchart showing the steps in a method of filling a water bottle according to the present invention.

FIG. 8 is a flowchart showing the steps in a method of filling a water bottle according to the present invention. The method comprises providing the water bottle, the water bottle comprising a bottom wall, an upwardly extending sidewall, a top wall, and a water filling and dispensing opening formed in the sidewall; and filling the water bottle with water via the water filling and dispensing opening.

Figure 9:
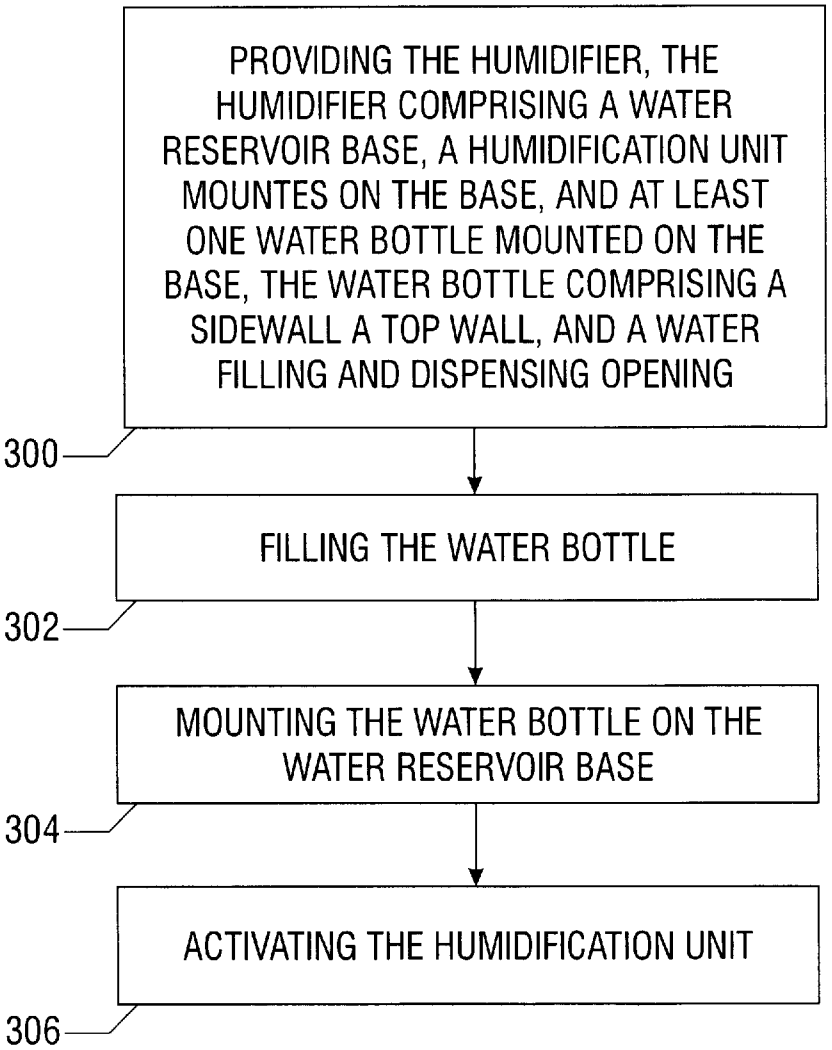
FIG. 9 is a flowchart showing the steps in a method of using a humidifier according to the present invention.

FIG. 9 is a flowchart showing the steps in a method of using a humidifier according to the present invention. The method comprises providing the humidifier, the humidifier comprising a water reservoir base, a humidification unit mounted on the base, and at least one water bottle mounted on the base, the water bottle comprising a bottom wall, an upwardly extending sidewall, a top wall, and a water filling and dispensing opening extending outwardly from the sidewall; filling the water bottle; mounting the water bottle on the water reservoir base; and activating the humidification unit.

From the foregoing, it will now be appreciated that the water bottle of the present invention has a novel construction and arrangement of features. The water bottle is constructed with novel water filling and dispensing system including a water filling and dispensing cap that is threadably associated with a water filling and dispensing spout defining a water filling and dispensing opening in the side wall of the water bottle. This enables the user to quickly and conveniently fill the water bottle, while permitting the water bottle to dispense water through the water filling and dispensing cap. Also, the humidifier of the present invention has a novel construction and arrangement of features in order to make use of water bottles of the present invention.

All of the apparatus disclosed and claimed herein can be made and executed without undue experimentation in light of the present disclosure. While the apparatus of this invention have been described in terms of preferred embodiments, it will be apparent to those of skill in the art that variations may be applied to the apparatus described herein without departing from the concept, spirit and scope of the invention. All such variations apparent to those skilled in the art are deemed to be within the spirit, scope and concept of the invention as defined by the appended claims.

What is claimed is:

1. A humidifier, comprising:

a water reservoir base defining a valve actuator, a humidification unit mounted on the base, and, at least one water bottle mounted on the base, the water bottle comprising: a bottom wall, an upwardly extending sidewall, and a top wall, the sidewall defining an opening therein for filling and dispensing water, a cap removably mounted over the opening in the sidewall, and a spring biased valve stem situated in the cap, the water bottle being mounted on the base in a position wherein the actuator can engage the spring biased valve stem.

2. The humidifier of claim 1, wherein the water filling and dispensing opening is adjacent to the bottom wall.

3. The humidifier of claim 2, wherein the bottom wall of the water bottle is step-shaped, the step shape defining an upper horizontal section of the bottom wall and a lower horizontal section of the bottom wall.

4. The humidifier of claim 3, wherein the water filling and dispensing opening is in proximity to the lower horizontal section of the bottom wall.

5. The humidifier of claim 3, wherein the water reservoir base has a projection adjacent to a side wall of the water bottle.

6. A water bottle for use in a humidifier, comprising:

a bottom wall, an upwardly extending sidewall defining an opening therein for filling and dispensing water, a top wall, a cap removably mounted over the opening in the sidewall, and a spring biased valve stem situated in the cap.

7. The water bottle of claim 6, wherein the water filling and opening is adjacent to the bottom wall.

8. The water bottle of claim 6, wherein the bottom wall is step-shaped, the step shape defining an upper horizontal section of the bottom wall and a lower horizontal section of the bottom wall.

9. The water bottle of claim 8, wherein the water filling and dispensing opening is in proximity to the lower horizontal section of the bottom wall.

10. A method of dispensing water from a water bottle for use in a humidifier, comprising:

providing the water bottle, the water bottle comprising a bottom wall, an upwardly extending sidewall, a top wall, and a water filling and dispensing opening formed in the sidewall, wherein a water filling and dispensing cap is threadably mounted on the water filling and dispensing opening and a spring biased valve stem is formed in the water filling and dispensing cap, and wherein the water bottle contains water to a level above the bottom of the spring biased valve stem;

providing the humidifier, the humidifier comprising a water reservoir base with a fixed button valve actuator formed thereon in position to engage the spring biased valve stem when the water bottle is mounted in the humidifier; and, mounting the water bottle on the humidifier such that the fixed button valve actuator engages the spring biased valve stem.

11. The method of claim 10 further comprising filling the water bottle with water via the water filling and dispensing opening.

* * * * *